US010336502B2

(12) United States Patent
Kunishima et al.

(10) Patent No.: US 10,336,502 B2
(45) Date of Patent: Jul. 2, 2019

(54) CONTAINER WITH DUAL POSITION LID PORTIONS AND SYSTEM AND METHOD THEREOF

(71) Applicant: AJINOMOTO WINDSOR, INC., Ontario, CA (US)

(72) Inventors: Koichi Kunishima, Portland, OR (US); Craig Epperson, Portland, OR (US); Masashi Sekine, Portland, OR (US)

(73) Assignee: AJINOMOTO WINDSOR, INC., Ontario, CA (US)

( * ) Notice: Subject to any disclaimer, the term of this patent is extended or adjusted under 35 U.S.C. 154(b) by 102 days.

(21) Appl. No.: 15/676,130

(22) Filed: Aug. 14, 2017

(65) Prior Publication Data

US 2019/0047746 A1 Feb. 14, 2019

(51) Int. Cl.

| | |
|---|---|
| ***B65D 5/10*** | (2006.01) |
| ***B65D 5/66*** | (2006.01) |
| ***B65D 5/00*** | (2006.01) |
| ***B65D 5/42*** | (2006.01) |
| ***B65D 5/30*** | (2006.01) |
| ***B65D 5/22*** | (2006.01) |

(52) U.S. Cl.

CPC ..... *B65D 5/6635* (2013.01); *B65D 5/0085* (2013.01); *B65D 5/22* (2013.01); *B65D 5/307* (2013.01); *B65D 5/308* (2013.01); *B65D 5/4266* (2013.01); *B65D 5/10* (2013.01); *B65D 5/103* (2013.01); *B65D 5/6602* (2013.01); *B65D 5/6614* (2013.01); *B65D 5/6676* (2013.01)

(58) Field of Classification Search

CPC ..... B65D 5/10; B65D 5/103; B65D 5/106; B65D 5/22; B65D 5/206; B65D 5/66; B65D 5/6676; B65D 5/6635; B65D 5/6614; B65D 5/6602; B65D 5/6605

USPC ..... 229/103, 108.1, 125

See application file for complete search history.

(56) References Cited

U.S. PATENT DOCUMENTS 2,426,484 A * 8/1947 Buffenbarger ..... B65D 5/0254 224/240
2,695,097 A * 11/1954 Easton ..... B65D 5/5206 206/45.21

(Continued)

FOREIGN PATENT DOCUMENTS

| | | |
|---|---|---|
| JP | 52-67535 | 5/1977 |
| JP | 2004-123230 | 4/2004 |
| JP | 2008-68885 | 3/2008 |

*Primary Examiner* — Justin M Larson

(74) *Attorney, Agent, or Firm* — Oblon, McClelland, Maier & Neustadt, L.L.P.

(57) ABSTRACT

Containment systems, containers, and methods can be comprised of first through fourth sidewalls; a bottom wall connected to the first through fourth sidewalls; and first through fourth lid flaps connected to respective first through fourth sidewalls via respective first through fourth hinges. A single sheet of paperboard can make up the sidewalls, the bottom wall, and the lid flaps. In a fully open configuration, the third lid flap can be folded at the third hinge such that a flap body thereof is adjacent to the third sidewall, the fourth lid flap can be folded at the fourth hinge such that a flap body thereof is adjacent to the fourth sidewall, and a flap wing of each of the third lid flap and the fourth lid flap can be under the bottom wall such that each of the flap wings is against the bottom wall and maintained under the bottom wall.

20 Claims, 10 Drawing Sheets

(56) References Cited

U.S. PATENT DOCUMENTS

| | | | | |
|---|---|---|---|---|
| 5,435,437 | A * | 7/1995 | Sasaki | B65D 1/22 206/305 |
| 8,042,728 | B2 | 10/2011 | Braoudakis | |
| 9,487,323 | B2 | 11/2016 | Yamamura | |
| 9,505,536 | B2 | 11/2016 | Dwork | |
| 2013/0126593 | A1* | 5/2013 | Mandreucci | B23P 17/00 229/125 |
| 2016/0075465 | A1 | 3/2016 | Wiley | |
| 2016/0302621 | A1 | 10/2016 | Yafei | |
| 2016/0318652 | A1 | 11/2016 | Torbert et al. | |
| 2017/0096251 | A1 | 4/2017 | Wiley | |

* cited by examiner

CONTAINER WITH DUAL POSITION LID PORTIONS AND SYSTEM AND METHOD THEREOF

FIELD

Embodiments of the disclosed subject matter are directed generally to containment systems, containers, and methods thereof.

SUMMARY

According to one or more embodiments of the present disclosure, a container is provided. The container can be comprised of a first sidewall; a second sidewall opposite the first sidewall; a third sidewall; a fourth sidewall opposite the third sidewall; a bottom wall connected to the first, second, third, and fourth sidewalls; a first lid flap connected to the first sidewall via a first hinge; a second lid flap connected to the second sidewall via a second hinge; a third lid flap connected to the third sidewall via a third hinge; and a fourth lid flap connected to the fourth sidewall via a fourth hinge. At least two of the first lid flap, the second lid flap, the third lid flap, and the fourth lid flap each may include a flap body and a flap wing connected to the flap body via a fifth hinge. In a fully open configuration, at least two of the following may be provided: the first lid flap can be folded at the first hinge such that the flap body thereof is adjacent to the first sidewall, the second lid flap can be folded at the second hinge such that the flap body thereof is adjacent to the second sidewall, the third lid flap can be folded at the third hinge such that the flap body thereof is adjacent to the third sidewall, the fourth lid flap can be folded at the fourth hinge such that the flap body thereof is adjacent to the fourth sidewall, and the flap wing of each of said at least two of the first lid flap, the second lid flap, the third lid flap, and the fourth lid flap can be under the bottom wall, such that each of said at least two flap wings is against the bottom wall and maintained under the bottom wall in the fully open configuration.

Additionally, one or more embodiments may involve or include a method regarding a container. The method can be comprised of providing a paper product; and providing a formed container formed from the paper product. The container may include a first sidewall, a second sidewall opposite the first sidewall, a third sidewall, a fourth sidewall opposite the third sidewall, a bottom wall connected to the first, second, third, and fourth sidewalls, a first lid flap connected to the first sidewall via a first hinge, a second lid flap connected to the second sidewall via a second hinge, a third lid flap connected to the third sidewall via a third hinge, and a fourth lid flap connected to the fourth sidewall via a fourth hinge. At least two of the first lid flap, the second lid flap, the third lid flap, and the fourth lid flap each may include a flap body and a flap wing connected to the flap body via a fifth hinge. In a fully open configuration, at least two of the following may be provided: the first lid flap can be folded at the first hinge such that the flap body thereof is adjacent to the first sidewall, the second lid flap can be folded at the second hinge such that the flap body thereof is adjacent to the second sidewall, the third lid flap can be folded at the third hinge such that the flap body thereof is adjacent to the third sidewall, the fourth lid flap can be folded at the fourth hinge such that the flap body thereof is adjacent to the fourth sidewall. The flap wing of each of said at least two of the first lid flap, the second lid flap, the third lid flap, and the fourth lid flap can be under the bottom wall, such that each of said at least two flap wings is against the bottom wall and maintained under the bottom wall in the fully open configuration.

In one or more embodiments of the disclosed subject matter, a container may be provided, wherein the container can comprise a first sidewall; a second sidewall opposite the first sidewall; a third sidewall; a fourth sidewall opposite the third sidewall; a bottom wall connected to the first, second, third, and fourth sidewalls; a first lid flap connected to the first sidewall via a first hinge; a second lid flap connected to the second sidewall via a second hinge; a third lid flap connected to the third sidewall via a third hinge; and a fourth lid flap connected to the fourth sidewall via a fourth hinge. At least two of the first lid flap, the second lid flap, the third lid flap, and the fourth lid flap each may include a flap body and a flap wing connected to the flap body via a fifth hinge. In a fully open configuration, the fifth hinges of said at least two of the first lid flap, the second lid flap, the third lid flap, and the fourth lid flap can be adjacent to respective portions of the container where corresponding at least two of the first sidewall, the second sidewall, the third sidewall, and the fourth sidewall meet the bottom wall, such that each of the said at least two flap wings is against the bottom wall and maintained under the bottom wall in the fully open configuration.

According to one or more embodiments of the present disclosure, a semi-rigid container can be provided. The semi-rigid container can comprise: a first sidewall; a second sidewall opposite the first sidewall; a third sidewall; a fourth sidewall opposite the third sidewall; a bottom wall connected to respective bases of the first, second, third, and fourth sidewalls to define an inner volume of the semi-rigid container; a first lid flap connected to the first sidewall via a first predefined hinge; a second lid flap connected to the second sidewall via a second predefined hinge; a third lid flap connected to the third sidewall via a third predefined hinge; a fourth lid flap connected to the fourth sidewall via a fourth predefined hinge; a first folding wall connecting the first sidewall to the third sidewall; a second folding wall connecting the first sidewall to the fourth sidewall; a third folding wall connecting the second sidewall to the third sidewall; and a fourth folding wall connecting the second sidewall to the fourth sidewall. The semi-rigid container can be made of a single sheet of multi-layer paperboard. The third lid flap and the fourth lid flap can each include a flap body and a flap wing connected to the flap body via a fifth predefined hinge. In a fully open configuration of the semi-rigid container, the third lid flap can be folded at the third predefined hinge such that the flap body thereof is against the third sidewall, the fourth lid flap can be folded at the fourth predefined hinge such that the flap body thereof is against the fourth sidewall, and the flap wing of each of the third lid flap and the fourth lid flap can be under the bottom wall pointing toward the other flap wing such that each of the flap wings is flat against the bottom wall and maintained under the bottom wall and, together, form a base for the semi-rigid container in the fully open configuration. Each of the first predefined hinge, the second predefined hinge, the third predefined hinge, the fourth predefined hinge, and the fifth predefined hinge can be formed of perforations in a straight line in the single sheet of multi-layer paperboard.

Also, in one or more embodiments, a containment system can be provided. The containment system can comprise: a first sidewall; a second sidewall opposite the first sidewall; a third sidewall; a fourth sidewall opposite the third sidewall; a bottom wall connected to the first, second, third, and fourth sidewalls to define an inner volume; a first lid flap connected to the first sidewall via a first hinge; a second lid flap connected to the second sidewall via a second hinge; a third lid flap connected to the third sidewall via a third hinge; and a fourth lid flap connected to the fourth sidewall via a fourth hinge. A single sheet of paperboard can make up the first sidewall, the second sidewall, the third sidewall, the fourth sidewall, the bottom wall, the first lid flap, the second lid flap, the third lid flap, and the fourth lid flap. The third lid flap and the fourth lid flap can each include a flap body and a flap wing connected to the flap body via a fifth hinge. The first hinge, the second hinge, the third hinge, the fourth hinge, and the fifth hinge can be physically predefined hinges formed in the single sheet. In a fully open configuration, the third lid flap can be folded at the third hinge such that the flap body thereof is adjacent to the third sidewall, the fourth lid flap can be folded at the fourth hinge such that the flap body thereof is adjacent to the fourth sidewall, and the flap wing of each of the third lid flap and the fourth lid flap can be under the bottom wall such that each of the flap wings is against the bottom wall and maintained under the bottom wall in the fully open configuration.

Embodiments can also include a method regarding a containment system. The method can comprise providing a single sheet of a semi-rigid paper product, the single sheet of semi-rigid paper product having formed therein a first predefined hinge, a second predefined hinge, a third predefined hinge, a fourth predefined hinge, and plurality of fifth predefined hinges; and providing a formed container formed from the single sheet of the semi-rigid paper product. The formed container can include: a first sidewall, a second sidewall opposite the first sidewall, a third sidewall, a fourth sidewall opposite the third sidewall, a bottom wall connected to the first, second, third, and fourth sidewalls to define an inner volume of the formed container, a first lid flap connected to the first sidewall via the first predefined hinge, a second lid flap connected to the second sidewall via the second predefined hinge, a third lid flap connected to the third sidewall via the third predefined hinge, and a fourth lid flap connected to the fourth sidewall via the fourth predefined hinge. The third lid flap and the fourth lid flap each can include a flap body and a flap wing connected to the flap body via the fifth predefined hinge. The formed container can be configured to be arranged in a fully open configuration such that the third lid flap is folded at the third predefined hinge such that the flap body thereof is adjacent to the third sidewall, the fourth lid flap is folded at the fourth hinge such that the flap body thereof is adjacent to the fourth sidewall, and the flap wing of each of the third lid flap and the fourth lid flap is under the bottom wall such that each of the flap wings is against the bottom wall and maintained under the bottom wall in the fully open configuration.

BRIEF DESCRIPTION OF THE DRAWINGS

The accompanying drawings, which are incorporated in and constitute a part of the specification, are illustrative of one or more embodiments of the disclosed subject matter, and, together with the description, explain various embodiments of the disclosed subject matter. Further, the accompanying drawings have not necessarily been drawn to scale, and any values or dimensions in the accompanying drawings are for illustration purposes only and may or may not represent actual or preferred values or dimensions. Where applicable, some or all select features may not be illustrated to assist in the description and understanding of underlying features.

DETAILED DESCRIPTION

Figure 1:
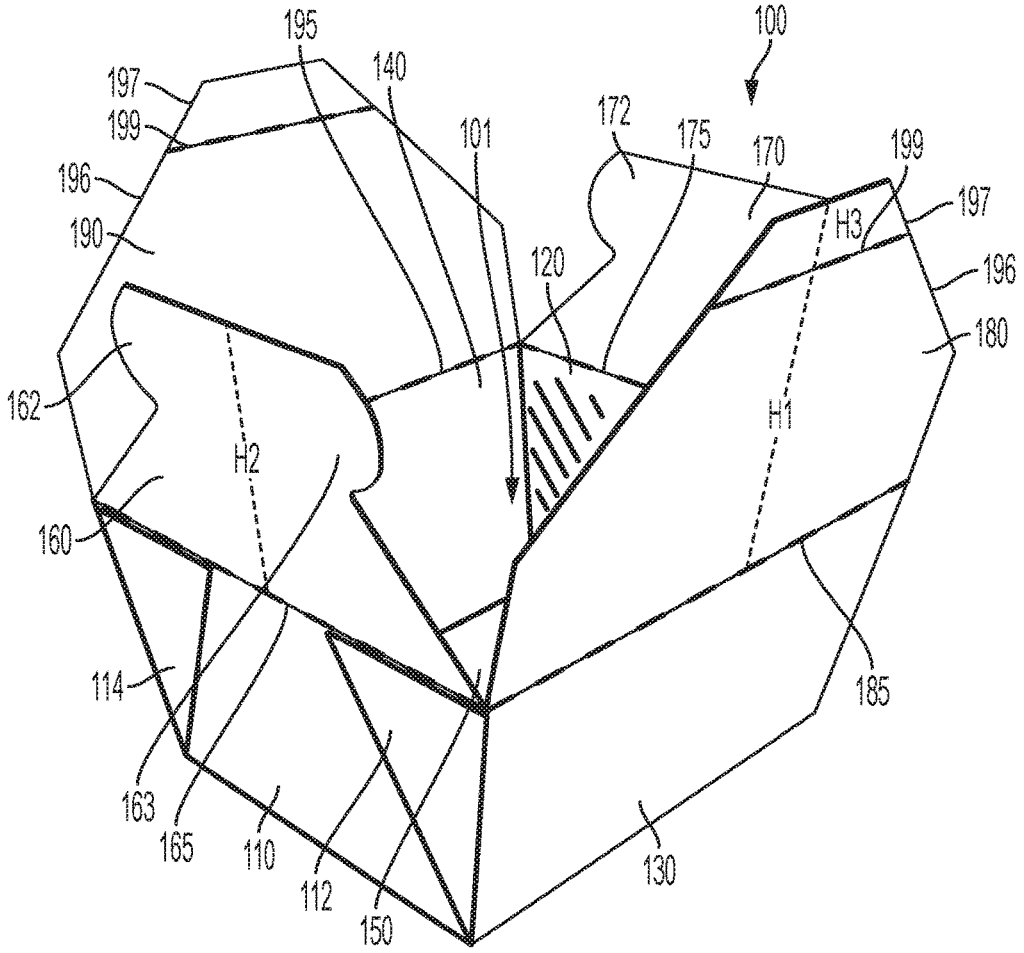
FIG. 1 is a top perspective view of a containment system or a container in a partially open configuration according to one or more embodiments of the disclosed subject matter.

The description set forth below in connection with the appended drawings is intended as a description of various embodiments of the described subject matter and is not necessarily intended to represent the only embodiment(s). In certain instances, the description includes specific details for the purpose of providing an understanding of the described subject matter. However, it will be apparent to those skilled in the art that embodiments may be practiced without these specific details. In some instances, structures and components may be shown in block diagram form in order to avoid obscuring the concepts of the described subject matter. Wherever possible, the same reference numbers will be used throughout the drawings to refer to the same or the like parts.

Any reference in the specification to "one embodiment" or "an embodiment" means that a particular feature, structure, characteristic, operation, or function described in connection with an embodiment is included in at least one embodiment. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments, and it is intended that embodiments of the described subject matter can and do cover modifications and variations of the described embodiments.

It must also be noted that, as used in the specification, appended claims and abstract, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the described subject matter to any particular orientation or configuration. Furthermore, terms such as "first," "second," "third," etc. merely identify one of a number of portions, components, points of reference, operations and/or functions as described herein, and likewise do not necessarily limit embodiments of the described subject matter to any particular configuration or orientation.

Embodiments of the disclosed subject matter are directed generally to containment systems, containers, and methods thereof. Generally speaking, containers of containment systems or methods, according to one or more embodiments of the disclosed subject matter, can have at least one or a plurality of dual position lid portions (e.g., lid flaps) that can be arranged in two predetermined positions, a first predefined position when the container is fully open and a second predefined position when the container is fully closed.

In the fully open position of the container, one, a set (e.g., a pair), all but one, or all of the lid portions can be folded outward about a predefined hinge such that a body portion thereof is adjacent to or against (as used herein, "against" may be interpreted as adjacent to and in contact with or touching) a respective sidewall of the container and an end portion or wing of the lid portion is against a bottom wall of the container so as to be maintained under the bottom wall of the container, for example, when the container rests on a surface, such as a table or plate. Thus, the one, the set, all but one, or all of the lid portions with the wing can be opened to the fully open position and maintained under the bottom wall. Consequently, such lid portion(s) may not interfere with access to the container, particularly an inner volume thereof, for instance, when foodstuff in the inner volume is removed from the container for consumption or distribution. Likewise, such lid portion(s) may not unnecessarily protrude and therefore can reduce an overall footprint of the container, particularly if the surface on which the container is placed has or will have other articles, such as another said container, other containers, utensils, etc. Optionally, the weight of the product inside the container, for instance, foodstuff, may assist with maintaining the wing(s) under the bottom wall of the container. That is, the weight of the product inside the container may keep or assist with keeping the wing(s) under the bottom wall of the container.

Additionally or alternatively, in the fully open position of the container, one, a set (e.g., a pair), all but one, or all of the lid portions can be folded outward about a predefined hinge such that a body portion thereof is against or adjacent to a respective sidewall of the container and retained adjacent to or against only the respective sidewall, and not the bottom wall, by way of at least one retention mechanism (e.g., opposing retention flanges on each lid portion between a folding wall and the respective sidewall). Thus, the one, the set, all but one, or all of the lid portions can be opened to the fully open position and maintained under the bottom wall. Consequently, such lid portion(s) may not interfere with access to the container, particularly the inner volume thereof, for instance, when foodstuff in the inner volume is removed from the container for consumption or distribution. Likewise, such lid portion(s) may not unnecessarily protrude and therefore can reduce the overall footprint of the container, particularly if the surface on which the container is placed has or will have other articles, such as another said container, other containers, utensils, etc.

In the fully closed position, the lid portions, whether all the same or different paired combinations, can form a lid for the container and fully enclose the container, along with the rest of the sidewalls and bottom wall. In the fully closed position, the lid portions may be parallel or substantially parallel to the bottom wall. Regarding substantially parallel, the contents of the container may be filled in the container such that the lid portions are not entirely parallel, and instead are slightly bowed.

Containers according to one or more embodiments of the disclosed subject matter can be made of relatively rigid material (i.e., semi-rigid), such as a plastic- or a paper-based product, including, but not limited to, cardboard or paperboard (e.g., multi-layer paperboard). Further, containers according to one or more embodiments of the disclosed subject matter can be formed from a single piece of relatively material (e.g., semi-rigid material), such as the plastic- or paper-based product discussed above. That is, containers according to embodiments of the disclosed subject matter may consist of a single piece of relatively rigid material. Of course, optionally, such embodiments may also implement adhesives to close the lid portions in the fully closed position and/or to affix a folding wall to a sidewall.

Turning now to the figures, FIG. 1 shows a top perspective view of a containment system or a container 100 (hereinafter "container 100") according to one or more embodiments of the disclosed subject matter. The container 100 in FIG. 1 is shown in a partially open configuration, which, in one or more embodiments, can be a stacking configuration, whereby multiple containers 100 can be stacked on top of each other, each container 100 being provided in an inner volume 101 of a subjacent container 100.

Container 100 can have a first sidewall 110, a second sidewall 120, which may be opposite the first sidewall 110, a third sidewall 130, and a fourth sidewall 140, which may be opposite the third sidewall 130. The container 100 can also include a bottom wall 150, which may be connected to the first sidewall 110, the second sidewall 120, the third sidewall 130, and the fourth sidewall 140, for instance, to respective bases of these sidewalls, to define the inner volume 101 of the container 100.

The container 100 can also have a first lid flap 160, a second lid flap 170, a third lid flap 180, and a fourth lid flap 190. The first lid flap 160 may be connected to the first sidewall 110 via a first hinge 165. The second lid flap 170 may be connected to the second sidewall 120 via a second hinge 175. The third lid flap 180 may be connected to the third sidewall 130 via a third hinge 185. The fourth lid flap 190 may be connected to the fourth sidewall 140 via a fourth hinge 195.

The first hinge 165 and the second hinge 175 may be predefined hinges, meaning the means by which they provide for movement of the first lid flap 160 and the second lid flap 170 relative to the first sidewall 110 and the second sidewall 120, respectively, can be visible or otherwise identified prior to movement thereof. For example, FIG. 1 illustrates each of the first hinge 165 and the second hinge 175 being defined by perforations, for instance, a straight line of perforations, that define the respective hinge points. Alternatively, the first hinge 165 and the second hinge 175 each can be a fold or crease line, for instance, a non-perforated fold line. Further, predefined in the context of hinges as described herein, can mean that the hinge is defined in the pattern of the container 100, before the container is manipulated to form a formed container, such as container 100. See, for example, FIGS. 9 and 10.

Additionally or alternatively, the third hinge 185 and the fourth hinge 195 may be predefined hinges, meaning the means by which they provide for movement of the third lid flap 180 and the fourth lid flap 190 relative to the third sidewall 130 and the fourth sidewall 140, respectively, can be visible or otherwise identified prior to movement thereof. For example, FIG. 1 illustrates each of the third hinge 185 and the fourth hinge 195 being defined by perforations, for instance, a straight line of perforations, that define the respective hinge points. Alternatively, the third hinge 185 and the fourth hinge 195 each can be a fold or crease line, for instance, a non-perforated fold line. Further, as noted above, predefined in the context of hinges as described herein, can mean that the hinge is defined in the pattern of the container 100, before the container is manipulated to form a formed container, such as container 100. See, for example, FIGS. 9 and 10.

Optionally, the first lid flap 160 and the second lid flap 170 and/or the third lid flap 180 and the fourth lid flap 190 may be detachable from the container 100. For example, the above-discussed perforations that may form each of the first hinge 165, the second hinge 175, the third hinge 185, and the fourth hinge 195 may be configured to provide for detachment of the corresponding lid flaps.

As shown in FIG. 1, for instance, the first lid flap 160 and the second lid flap 170 may have a geometrical configuration or outline, and the third lid flap 180 and the fourth lid flap 190 may have a geometrical configuration or outline different from the geometrical configuration or outline of the first lid flap 160 and the second lid flap 170.

Alternative to the container 100 in FIG. 1, or variations thereof, according to one or more embodiments of the disclosed subject matter, the lid flaps may all have the configuration of the third lid flap 180 and the fourth lid flap 190, or the lid flaps may all have the configuration of the first lid flap 160 and the second lid flap 170. In yet another alternative embodiment, only one of the lid flaps may have the configuration of the third lid flap 180 and the fourth lid flap 190, or, only one of the lid flaps may have the configuration of the first lid flap 160 and the second lid flap 170.

The inner volume 101 of the container 100 may be defined by a volumetric geometrical shape, such as a volumetric trapezoid according to the container 100 in FIG. 1, or, alternatively, one of a volumetric rectangle or a cube, for instance.

Optionally, the container 100 can have a first folding wall 112 and a second folding wall 114. The first folding wall 112 can be between the first sidewall 110 and the third sidewall 130. The second folding wall 114 can be between the first sidewall 110 and the fourth sidewall 140. Optionally, the first folding wall 112 may connect the first sidewall 110 to the third sidewall 130, and the second folding wall 114 may connect the first sidewall 110 to the fourth sidewall 140. The container 100 can also have a third folding wall 132 and a fourth folding wall 134 (now shown in FIG. 1). The third folding wall 132 can be between the second sidewall 120 and the third sidewall 130. The fourth folding wall 143 can be between the second sidewall 120 and the fourth sidewall 140. Optionally, the third folding wall 132 may connect the second sidewall 120 to the third sidewall 130, and the fourth folding wall 134 may connect the second sidewall 120 to the fourth sidewall 140.

The third lid flap 180 and the fourth lid flap 190 each can include a flap body 196 and a flap wing 197 connected to the flap body 196 via a fifth hinge 199. The fifth hinge 199 may be a predefined hinge, meaning the means by which the fifth hinge 199 provides for movement of the flap wing 197 relative to the flap body 196 can be visible or otherwise identified prior to movement thereof. For example, FIG. 1 illustrates each fifth hinge 199 being defined by perforations, for instance, a straight line of perforations, that define the respective hinge points. Alternatively, the fifth hinge 199 can be a fold line, for instance, a non-perforated fold line. Further, predefined in the context of hinges as described herein, can mean that the hinge is defined in the pattern of the container 100, before the container is manipulated to form a formed container, such as container 100. Optionally, each fifth hinge 199 may not be removable from the flap body 196, even though the fifth hinge 199 may be formed using perforations.

Optionally, in one or more embodiments of the disclosed subject matter, a height H1 of the flap body 196 may be greater than a height H2 of the first lid flap 160 and the second lid flap 170. Also, the height H1 of the flap body 196 may be greater than a height H3 of the flap wing 197. The height H2 of the first lid flap 160 and the second lid flap 170 may also be greater than the height H3 of the flap wing 197.

The first lid flap 160 may be configured to be retained by the first folding wall 112 and the second folding wall 114. Likewise, the second lid flap 170 may be configured to be retained by the third folding wall 132 and the fourth folding wall 134. Thus, in one or more embodiments of the disclosed subject matter, the first lid flap 160 can include a pair of retention flanges 162, 163, for instance, opposing retention flanges. Likewise, the second lid flap 170 can include a pair of retention flanges 172, 173 (retention flange 173 not shown in FIG. 1), for instance, opposing retention flanges.

Figure 2:
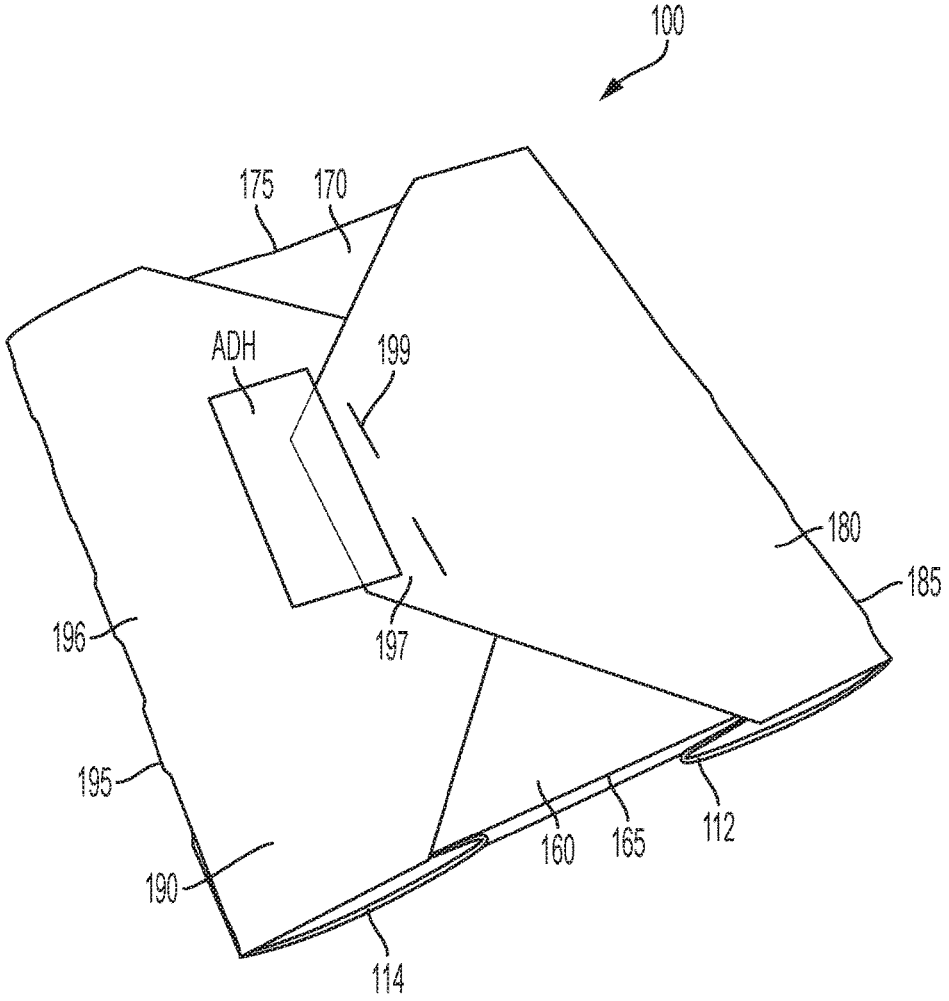
FIG. 2 is a top view of the container of FIG. 1 in a fully closed configuration.

FIG. 2 is a top view of the container 100 in a fully closed configuration. Notably, in the fully closed position, the first lid flap 160, the second lid flap 170, the third lid flap 180, and the fourth lid flap 190 may be parallel or substantially parallel to the bottom wall 150. Regarding substantially parallel, the lid flaps may be slightly above parallel, for instance, due to the constitution of the material forming the container 100 (e.g., paperboard) and/or product contained in the inner volume 101 protruding above the tops of the first sidewall 110, the second sidewall 120, the third sidewall 130, and the fourth sidewall 140.

Figure 3:
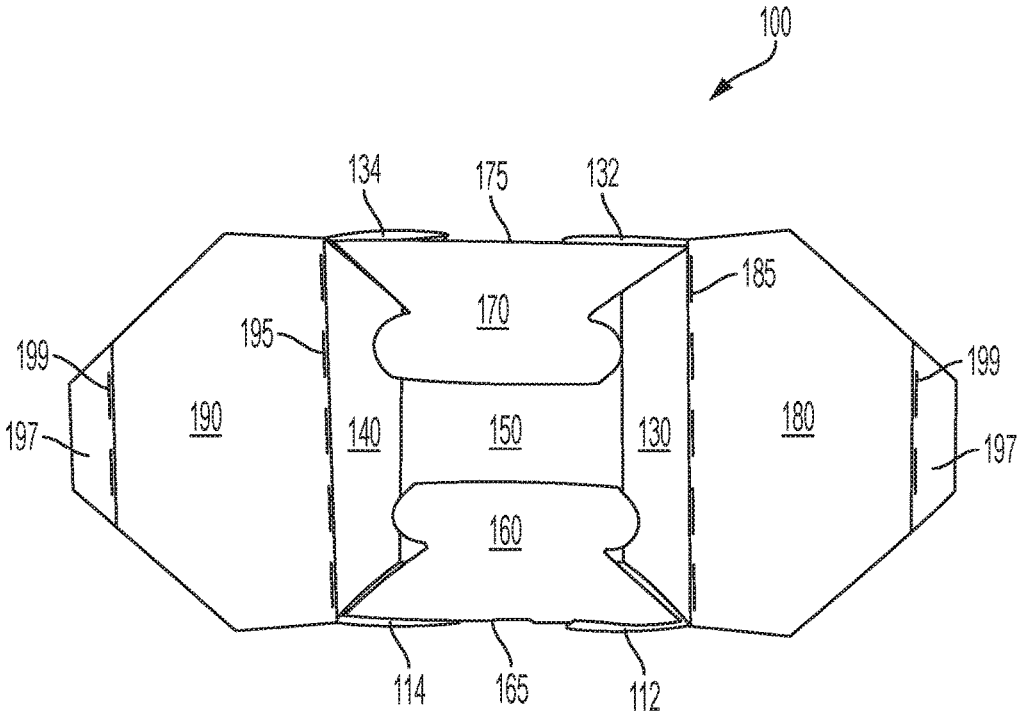
FIG. 3 is a top plan view of the container of FIG. 1 in a partially closed configuration according to one or more embodiments of the disclosed subject matter.

In the fully closed configuration, optionally, the first lid flap 160 and the second lid flap 170 may not overlap each other. Though FIG. 3 shows the container 100 in a partially closed position, rather than a fully closed configuration, FIG. 3 may be illustrative of the first lid flap 160 and the second lid flap 170 not overlapping when in the fully closed position. Optionally, each of the third lid flap 180 and the fourth lid flap 190 may overlap both the first lid flap 160 and the second lid flap 170 in the fully closed position. Additionally, the third lid flap 180 and the fourth lid flap 190 may overlap each other in the fully closed position of the container 100. Note that though FIG. 2 shows the third lid flap 180 being on top of or over the fourth lid flap 190 in the fully closed position, the fourth lid flap 190 may also be arranged on top of or over the third lid flap 180. The third lid flap 180 and the fourth lid flap 190 can be on top of or over the first lid flap 160 and the second lid flap 170. Optionally, an adhesive ADH, such as tape, may be provided to keep the third lid flap 180 affixed to the fourth lid flap 190 or vice versa, depending upon which of the third lid flap 180 and the fourth lid flap 190 is the top-most lid flap. Thus, in one or more embodiments of the disclosed subject matter, the lid flaps, particularly the third lid flap 180 and the fourth lid flap 190 may be free or without any connection mechanisms to connect these two lid flaps together to keep the container 100 closed.

Figure 4:
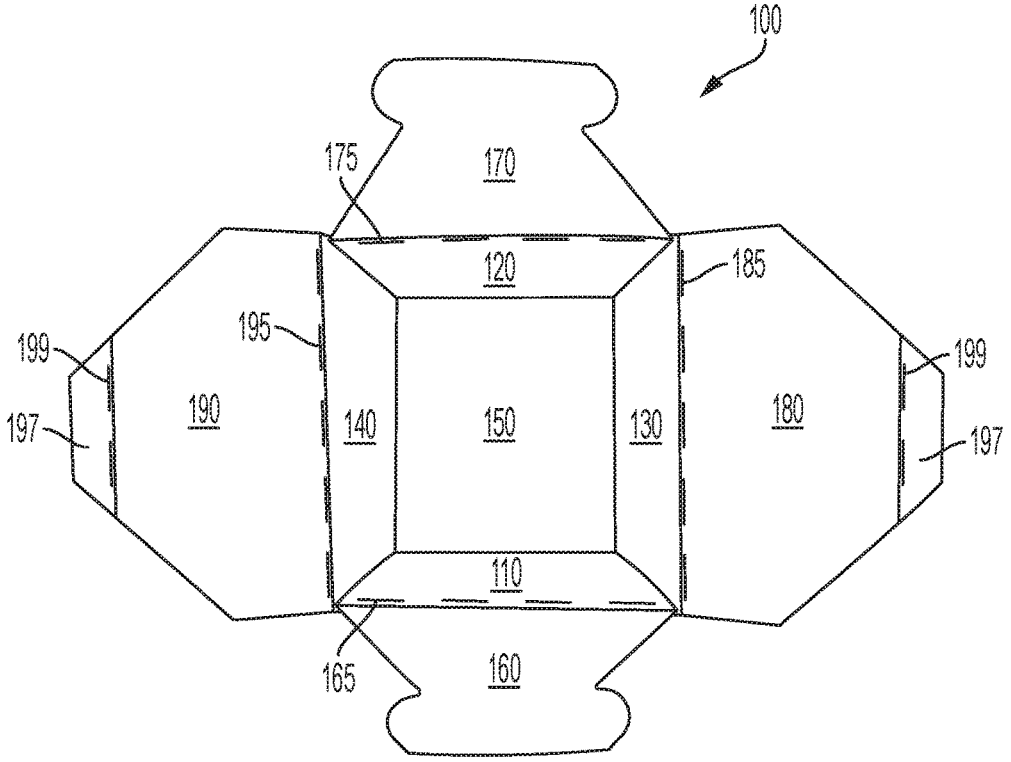
FIG. 4 is a top plan view of the container of FIG. 1 in a partially open configuration according to one or more embodiments of the disclosed subject matter.
Figure 5:
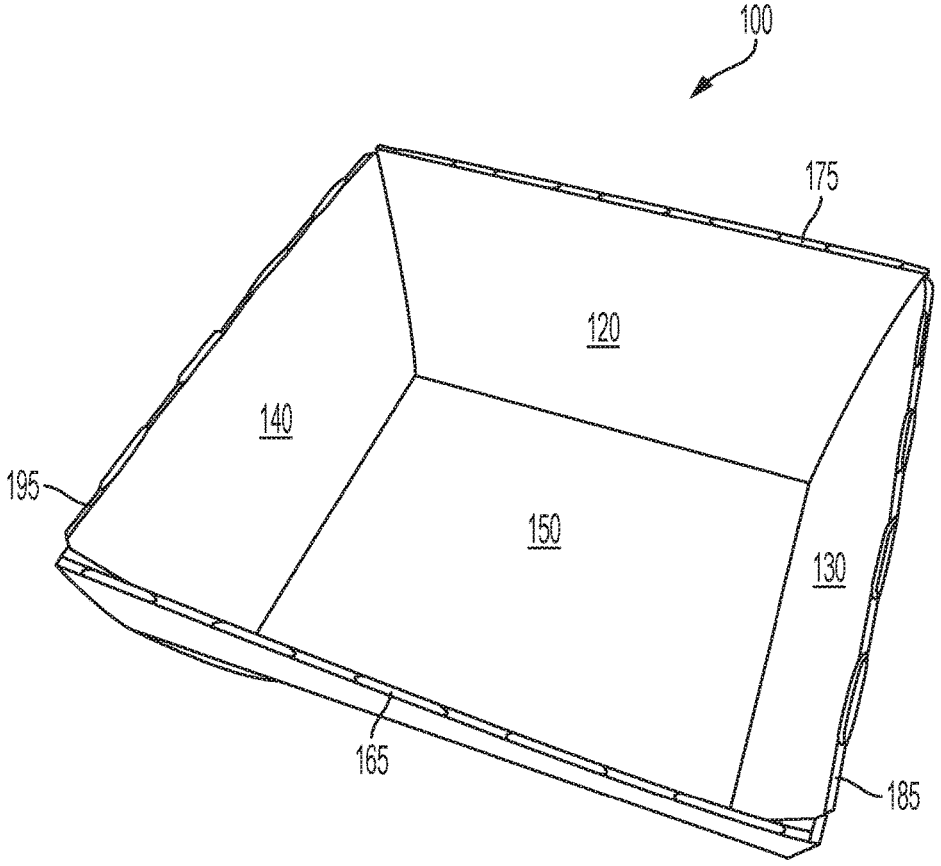
FIG. 5 is a top perspective view of the container of FIG. 1 in a fully open configuration according to one or more embodiments of the disclosed subject matter.

As noted above, FIG. 3 shows the container 100 in a partially closed configuration. FIG. 4 shows the container 100 in a partially open configuration. Thus, from the fully closed position of FIG. 2, to reach the partially closed configuration of FIG. 3, the third lid flap 180 may be rotated about the third hinge 185 to expose a portion of the opening of the container 100 formed by the tops of the first sidewall 110, the second sidewall 120, the third sidewall 130, and the fourth sidewall 140. Likewise, the fourth lid flap 190 may be rotated about the third hinge 195 to expose another portion of the opening of the container 100 formed by the tops of the first sidewall 110, the second sidewall 120, the third sidewall 130, and the fourth sidewall 140. To reach the partially open configuration of FIG. 4, the first lid flap 160 may be rotated about the first hinge 165 to expose yet another portion of the opening of the container 100 formed by the tops of the first sidewall 110, the second sidewall 120, the third sidewall 130, and the fourth sidewall 140. And the second lid flap 170 may be rotated about the first hinge 175 to expose yet another portion of the opening of the container 100 formed by the tops of the first sidewall 110, the second sidewall 120, the third sidewall 130, and the fourth sidewall 140. In the partially open position of the container 100 access to the inner volume 101 may not be obstructed by any of the lid flaps.

FIGS. 5-8 show various views of the container 100 in a fully open configuration. Like the partially open position of the container, in the fully open configuration access to the inner volume 101 may not be obstructed by any of the lid flaps. Also, generally speaking, in the fully open configuration some or all of the lid flaps may be retained or maintained in a particular setup, for instance, such that they do not interfere with access to the inner volume 101 of the container 100, do not unnecessarily protrude, and/or are not free to move.

Figure 6:
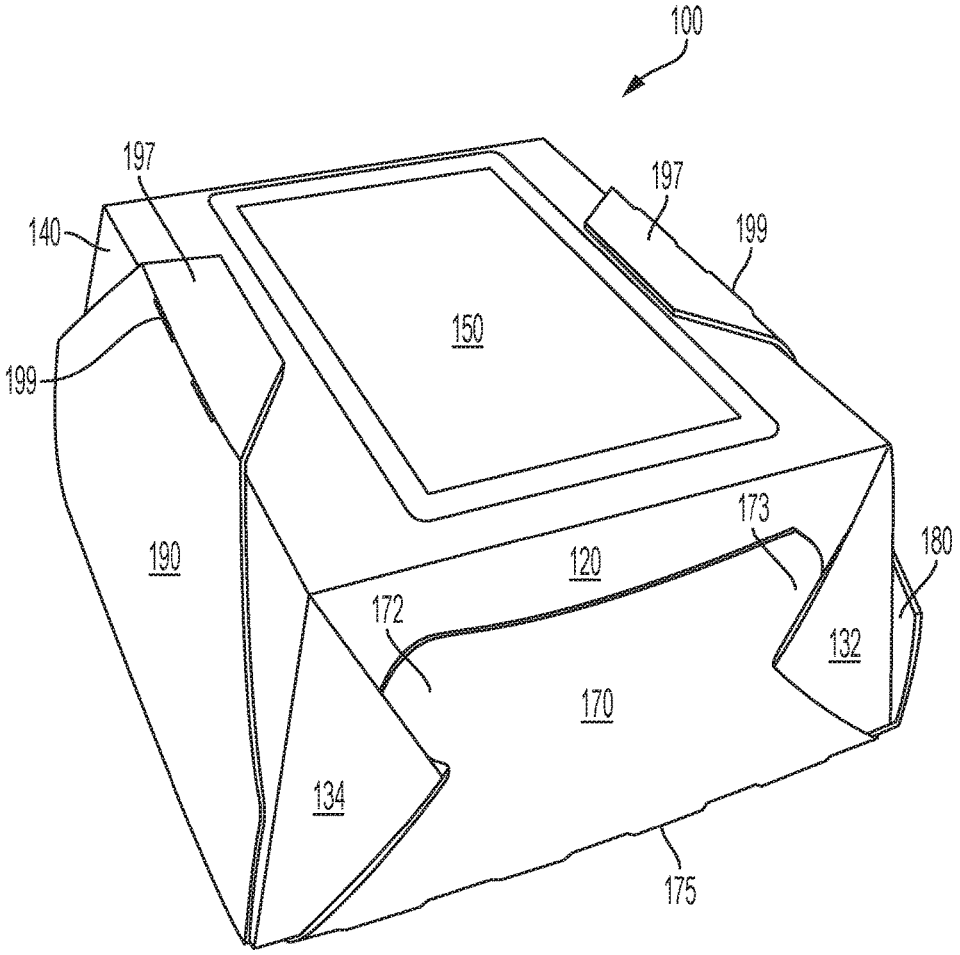
FIG. 6 is a bottom perspective view of the container of FIG. 1 in the fully open configuration according to one or more embodiments of the disclosed subject matter.
Figure 7:
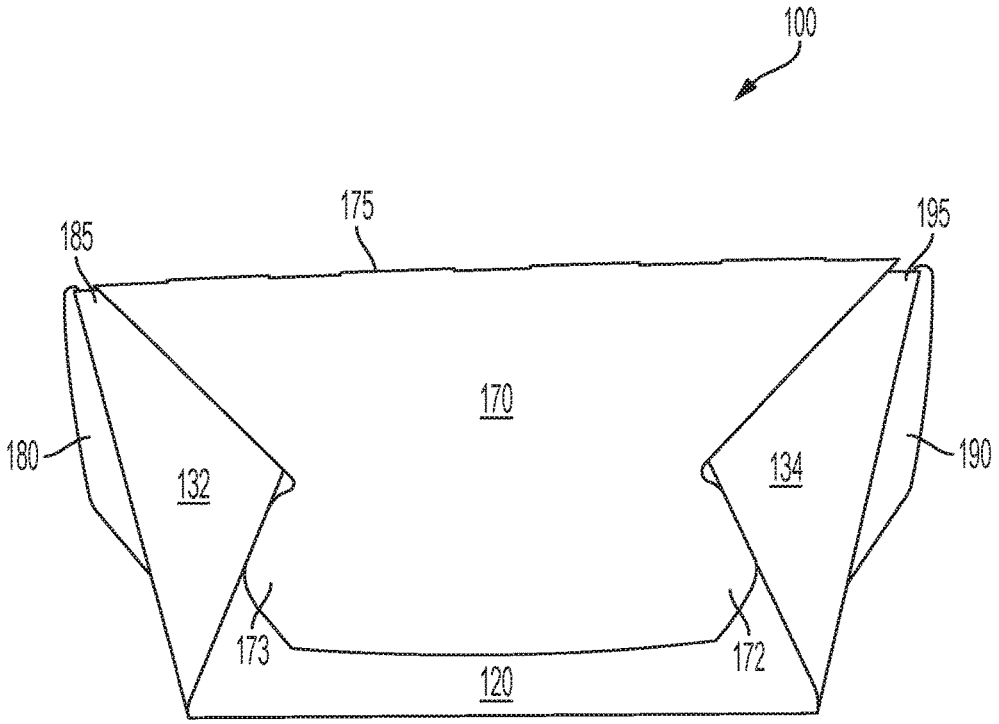
FIG. 7 is a side elevational view of the container of FIG. 1 in the fully open configuration according to one or more embodiments of the disclosed subject matter.
Figure 8:
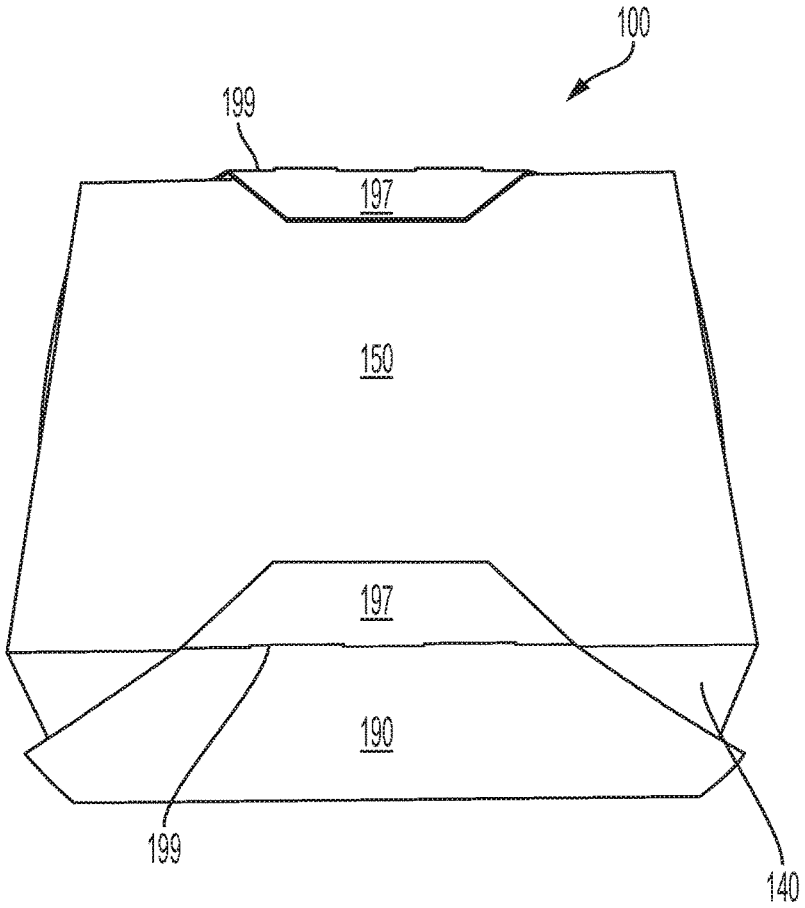
FIG. 8 is a bottom view of the container of FIG. 1 in the fully open configuration according to one or more embodiments of the disclosed subject matter.

In the fully open configuration of the container 100, the third lid flap 180 can be folded at the third hinge 185 such that the flap body 196 thereof is adjacent to the third sidewall 130; optionally, the third lid flap 180 may be against or contact the third sidewall 130. Similarly, the fourth lid flap 190 can be folded at the fourth hinge 195 such that the flap body 196 thereof is adjacent to the fourth sidewall 140; optionally, the fourth lid flap 190 may be against or contact the fourth sidewall 140. As can be seen from FIG. 6 and FIG. 8, the flap wing 197 of each of the third lid flap 180 and the fourth lid flap 190 can be rotated about the fifth hinge 199 to bring the flap wing 197 under the bottom wall 150. Optionally, ends of the flap wings 197 may point toward or face each other. Further, each flap wing 197 may be flat against the bottom wall 150, particularly if the container 100 is resting on a surface with the flap wings 197 on the surface, and more particularly under the weight of product, such as foodstuff, in the inner volume 101 of the container 100. The flap wings 197 may be maintained adjacent to or against the bottom wall 150. Thus, the flap wings 197, in the fully open configuration of the container 100, can form a base for the container 100. Optionally, in the fully open configuration of the container 100, the flap wings 197 may not overlap or touch each other, such as illustrated in FIG. 6 and FIG. 8. Optionally, adhesive, such as glue, may be provided to affix the flap wings 197 to the bottom wall 150.

Additionally or alternatively, in the fully open configuration of the container 100, the first lid flap 160 may be folded about the first hinge 165 so as to be arranged and retained between the first folding wall 112 and the first sidewall 110 and/or between the second folding wall 114 and the first sidewall 110. Similarly, in the fully open configuration of the container 100, the second lid flap 170 may be folded about the second hinge 175 so as to be arranged and retained between the third folding wall 132 and the second sidewall 120 and/or between the fourth folding wall 134 and the second sidewall 120.

More specifically, the retention flange 162 can be inserted into a pocket or space formed between the second folding wall 114 and the first sidewall 110. Optionally, an adhesive may be used to affix a portion or portions of the second folding wall 114 to the first sidewall 110. Of course, such affixing can leave unfixed a portion to create the pocket or space to receive the retention flange 162. Likewise, the retention flange 163 can be inserted into a pocket or space formed between the first folding wall 112 and the first sidewall 110. Optionally, an adhesive may be used to affix a portion or portions of the first folding wall 112 to the first sidewall 110. Of course, such affixing can leave unfixed a portion to create the pocket or space to receive the retention flange 163. The foregoing can be likewise applicable to the second lid flap 170, the third folding wall 132, the fourth folding wall 134, the retention flange 172, and the retention flange 173. Optionally, the adjacent portions of each of the folding walls may be affixed to each other using an adhesive, such as glue. Alternatively, the adjacent portions of each of the folding walls may be free of adhesive.

Figure 9:
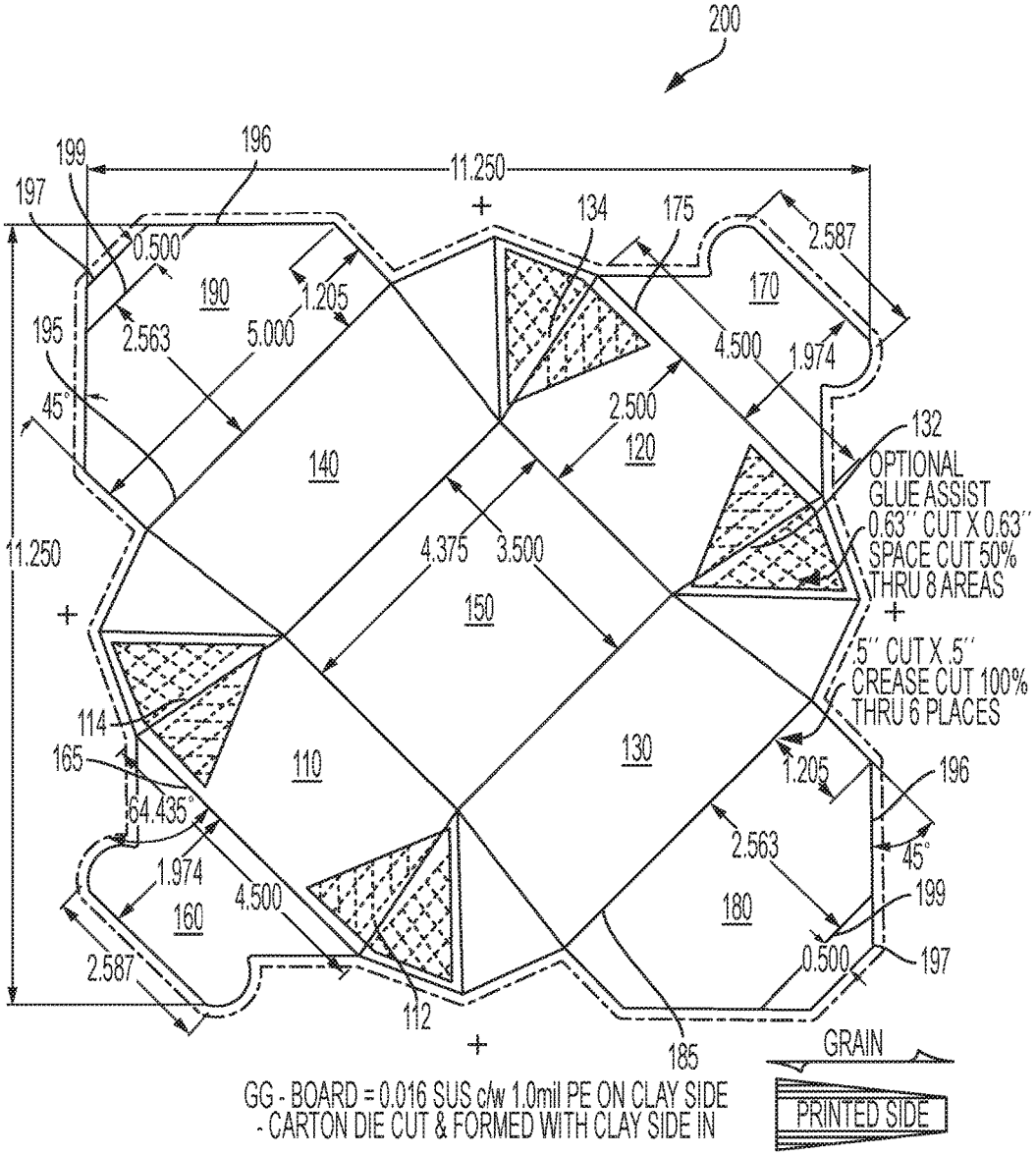
FIG. 9 is a schematic view of a sheet configured to be folded to form the container of FIG. 1.

FIG. 9 is a schematic view of a patterned sheet 200 configured to be manipulated (e.g., folded) to form the container 100. The specific configuration and dimensions of the sheet 200 are merely exemplary, and not intended to limit the same, shape, or ratios regarding containers according to embodiments of the disclosed subject matter. As noted above, the sheet 200 can be a single sheet made of relatively rigid material (i.e., semi-rigid), such as plastic or a paper-based product, such as cardboard or paperboard (e.g., multi-layer paperboard).

Figure 10:
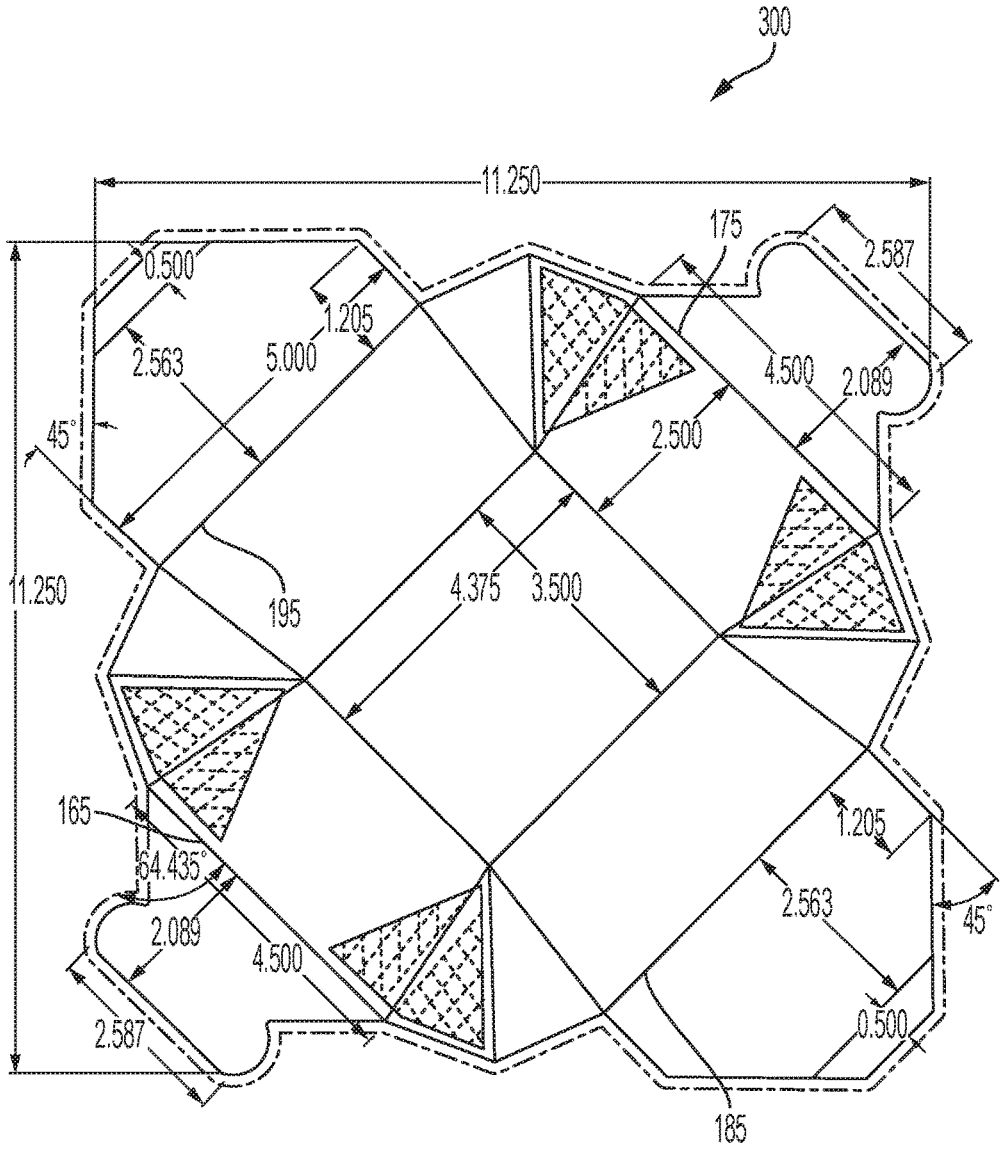
FIG. 10 is a schematic view of a sheet configured to be folded to form a container according to a variation of the container of FIG. 1.

FIG. 10 is a schematic view of a patterned sheet 300 configured to be manipulated (e.g., folded) to form a container similar to the container 100. Notably different from the container illustrated above, patterned sheet 300 and the corresponding container can be configured such that each of the first hinge 165, the second hinge 175, the third hinge 185, and the fourth hinge 195 is a hinge that is not formed by perforations, but rather by a crease, hinge, or fold line, for instance, a predetermined crease, hinge, or fold line.

The specific configuration and dimensions of the sheet 300 are merely exemplary, and not intended to limit the same, shape, or ratios regarding containers according to embodiments of the disclosed subject matter. The sheet 300 can be a single sheet made of relatively rigid material (i.e., semi-rigid), such as plastic or a paper-based product, such as cardboard or paperboard (e.g., multi-layer paperboard).

Embodiments of the disclosed subject matter may also be as set forth according to the parentheticals in the following paragraphs.

(1) A semi-rigid container can comprise: a first sidewall; a second sidewall opposite the first sidewall; a third sidewall; a fourth sidewall opposite the third sidewall; a bottom wall connected to respective bases of the first, second, third, and fourth sidewalls to define an inner volume of the semi-rigid container; a first lid flap connected to the first sidewall via a first predefined hinge; a second lid flap connected to the second sidewall via a second predefined hinge; a third lid flap connected to the third sidewall via a third predefined hinge; a fourth lid flap connected to the fourth sidewall via a fourth predefined hinge; a first folding wall connecting the first sidewall to the third sidewall; a second folding wall connecting the first sidewall to the fourth sidewall; a third folding wall connecting the second sidewall to the third sidewall; and a fourth folding wall connecting the second sidewall to the fourth sidewall. The semi-rigid container can be made of a single sheet of multi-layer paperboard. The third lid flap and the fourth lid flap can each include a flap body and a flap wing connected to the flap body via a fifth predefined hinge. In a fully open configuration of the semi-rigid container, the third lid flap can be folded at the third predefined hinge such that the flap body thereof is against the third sidewall, the fourth lid flap can be folded at the fourth predefined hinge such that the flap body thereof is against the fourth sidewall, and the flap wing of each of the third lid flap and the fourth lid flap can be under the bottom wall pointing toward the other flap wing such that each of the flap wings is flat against the bottom wall and maintained under the bottom wall and, together, form a base for the semi-rigid container in the fully open configuration. Each of the first predefined hinge, the second predefined hinge, the third predefined hinge, the fourth predefined hinge, and the fifth predefined hinge can be formed of perforations in a straight line in the single sheet of multi-layer paperboard.

(2) The semi-rigid container according to (1), wherein the inner volume of the semi-rigid container can be defined as one of a volumetric trapezoid, a volumetric rectangle, and a cube.

(3) The semi-rigid container according to (1) or (2), wherein, in a fully closed configuration of the semi-rigid container the first lid flap, the second lid flap, the third lid flap, and the fourth lid flap can be parallel or substantially parallel to the bottom wall, the first and second lid flaps do not overlap each other, and the third and fourth lid flaps overlap each other and the first and second lid flaps.

(4) The semi-rigid container according to any one of (1) to (3), wherein the first lid flap and the second lid flap can have a first geometrical configuration, and wherein the third lid flap and the fourth lid flap can have a second geometrical configuration different from the first geometrical configuration.

(5) The semi-rigid container according to any one of (1) to (4), wherein each of the first lid flap and the second lid flap can include a pair of opposing retention flanges, wherein, in the fully open configuration of the semi-rigid container, one of the retention flanges of the first lid flap can be arranged between the first sidewall and the first folding wall and another of the retention flanges of the first lid flap can be arranged between the first sidewall and the second folding wall, such that the first lid flap is folded at the first predefined hinge and retained against the first sidewall, and wherein, in the fully open configuration of the semi-rigid container, one of the retention flanges of the second lid flap can be arranged between the second sidewall and the third folding wall and another of the retention flanges of the second lid flap can be arranged between the second sidewall and the fourth folding wall, such that the second lid flap is folded at the second predefined hinge and retained against the second sidewall.

(6) The semi-rigid container according to any one of (1) to (5), wherein, in the fully open configuration the flap wings of the third lid flap and the fourth lid flap may not overlap or touch each other when arranged flat against the bottom wall and maintained under the bottom wall.

(7) The semi-rigid container according to any one of (1) to (6), wherein a first height of the flap body may be greater than a second height of each of the first lid flap and the second lid flap.

(8) The semi-rigid container according to any one of (1) to (7), wherein a first height of the flap body can be greater than a third height of the flap wing.

(9) The semi-rigid container according to any one of (1) to (8), wherein a first height of the flap body can be greater than a second height of each of the first lid flap and the second lid flap, wherein the first height of the flap body can be greater than a third height of the flap wing, and wherein the second height of each of the first lid flap and the second lid flap can be greater than the third height of the flap wing.

(10) The semi-rigid container according to any one of (1) to (9), wherein each of the third wing flap and the fourth wing flap is detachable and/or each of the first wing flap and the second wing flap is detachable.

(11) A containment system can comprise: a first sidewall; a second sidewall opposite the first sidewall; a third sidewall; a fourth sidewall opposite the third sidewall; a bottom wall connected to the first, second, third, and fourth sidewalls to define an inner volume; a first lid flap connected to the first sidewall via a first hinge; a second lid flap connected to the second sidewall via a second hinge; a third lid flap connected to the third sidewall via a third hinge; and a fourth lid flap connected to the fourth sidewall via a fourth hinge. A single sheet of paperboard can make up the first sidewall, the second sidewall, the third sidewall, the fourth sidewall, the bottom wall, the first lid flap, the second lid flap, the third lid flap, and the fourth lid flap. The third lid flap and the fourth lid flap can each include a flap body and a flap wing connected to the flap body via a fifth hinge. The first hinge, the second hinge, the third hinge, the fourth hinge, and the fifth hinge can be physically predefined hinges formed in the single sheet. In a fully open configuration, the third lid flap can be folded at the third hinge such that the flap body thereof is adjacent to the third sidewall, the fourth lid flap can be folded at the fourth hinge such that the flap body thereof is adjacent to the fourth sidewall, and the flap wing of each of the third lid flap and the fourth lid flap can be under the bottom wall such that each of the flap wings is against the bottom wall and maintained under the bottom wall in the fully open configuration.

(12) The containment system according to (11), wherein each of the first hinge, the second hinge, the third hinge, the fourth hinge, and the fifth hinge can be formed of perforations in the single sheet of paperboard.

(13) The containment system according to (11), wherein each of the first hinge, the second hinge, the third hinge, the fourth hinge, and the fifth hinge can be formed of a predefined, non-perforated fold line in the single sheet of paperboard.

(14) The containment system according to any one of (11) to (13), wherein each of the fifth hinges can be formed by a perforated line between the flap body and the flap wing.

(15) The containment system according to any one of (11) to (14), wherein the single sheet of paperboard is configured to store foodstuff.

(16) The containment system according to any one of (11) to (15) can further comprise: a first folding wall between the first sidewall and the third sidewall; a second folding wall between the first sidewall and the fourth sidewall; a third folding wall between the second sidewall and the third sidewall; and a fourth folding wall between the second sidewall and the fourth sidewall. Each of the first lid flap and the second lid flap can include a pair of opposing retention flanges. In the fully open configuration, one of the retention flanges of the first lid flap can be arranged between the first sidewall and the first folding wall and another of the retention flanges of the first lid flap can be arranged between the first sidewall and the second folding wall, such that the first lid flap is folded at the first hinge and arranged adjacent to the first sidewall. In the fully open configuration, one of the retention flanges of the second lid flap can be arranged between the second sidewall and the third folding wall and another of the retention flanges of the second lid flap can be arranged between the second sidewall and the fourth folding wall, such that the second lid flap is folded at the second hinge and arranged adjacent to the second sidewall.

(17) A method regarding a containment system can comprise: providing a single sheet of a semi-rigid paper product, the single sheet of semi-rigid paper product having formed therein a first predefined hinge, a second predefined hinge, a third predefined hinge, a fourth predefined hinge, and plurality of fifth predefined hinges; and providing a formed container formed from the single sheet of the semi-rigid paper product. The formed container can include: a first sidewall, a second sidewall opposite the first sidewall, a third sidewall, a fourth sidewall opposite the third sidewall, a bottom wall connected to the first, second, third, and fourth sidewalls to define an inner volume of the formed container, a first lid flap connected to the first sidewall via the first predefined hinge, a second lid flap connected to the second sidewall via the second predefined hinge, a third lid flap connected to the third sidewall via the third predefined hinge, and a fourth lid flap connected to the fourth sidewall via the fourth predefined hinge. The third lid flap and the fourth lid flap each can include a flap body and a flap wing connected to the flap body via the fifth predefined hinge. The formed container can be configured to be arranged in a fully open configuration such that the third lid flap is folded at the third predefined hinge such that the flap body thereof is adjacent to the third sidewall, the fourth lid flap is folded at the fourth hinge such that the flap body thereof is adjacent to the fourth sidewall, and the flap wing of each of the third lid flap and the fourth lid flap is under the bottom wall such that each of the flap wings is against the bottom wall and maintained under the bottom wall in the fully open configuration.

(18) The method according to (17), wherein the formed container can further include: a first folding wall between the first sidewall and the third sidewall, a second folding wall between the first sidewall and the fourth sidewall, a third folding wall between the second sidewall and the third sidewall, and a fourth folding wall between the second sidewall and the fourth sidewall. Each of the first lid flap and the second lid flap can include a pair of opposing retention flanges. In the fully open configuration of the formed container, one of the retention flanges of the first lid flap can be arranged between the first sidewall and the first folding wall and another of the retention flanges of the first lid flap can be arranged between the first sidewall and the second folding wall, such that the first lid flap is folded at the first predefined hinge and arranged adjacent to the first sidewall. In the fully open configuration of the formed container, one of the retention flanges of the second lid flap can be arranged between the second sidewall and the third folding wall and another of the retention flanges of the second lid flap can be arranged between the second sidewall and the fourth folding wall, such that the second lid flap is folded at the second predefined hinge and arranged adjacent to the second sidewall.

(19) The method according to (17) or (18), wherein an adhesive can affix the first folding wall and the second folding wall to the first sidewall and the third folding wall and the fourth folding wall to the second sidewall.

(20) The method according to any one of (17) to (19), wherein the formed container can configured to be arranged in a fully closed configuration such that the first lid flap, the second lid flap, the third lid flap, and the fourth lid flap are parallel or substantially parallel to the bottom wall, the first and second lid flaps do not overlap each other, and the third and fourth lid flaps overlap each other and the first and second lid flaps.

(21) A method of providing, making and/or using the semi-rigid container according to any one of (1) to (10).

(22) A method of providing, making and/or using the containment system according to any one of (11) to (17).

(23) A method of making and/or using the containment system according to any one of (18) to (20).

(24) A container comprising: a first sidewall; a second sidewall opposite the first sidewall; a third sidewall; a fourth sidewall opposite the third sidewall; a bottom wall connected to the first, second, third, and fourth sidewalls; a first lid flap connected to the first sidewall via a first hinge; a second lid flap connected to the second sidewall via a second hinge; a third lid flap connected to the third sidewall via a third hinge; and a fourth lid flap connected to the fourth sidewall via a fourth hinge, wherein at least two of the first lid flap, the second lid flap, the third lid flap, and the fourth lid flap each include a flap body and a flap wing connected to the flap body via a fifth hinge, and wherein, in a fully open configuration, at least two of the following are provided: the first lid flap is folded at the first hinge such that the flap body thereof is adjacent to the first sidewall, the second lid flap is folded at the second hinge such that the flap body thereof is adjacent to the second sidewall, the third lid flap is folded at the third hinge such that the flap body thereof is adjacent to the third sidewall, the fourth lid flap is folded at the fourth hinge such that the flap body thereof is adjacent to the fourth sidewall, and the flap wing of each of said at least two of the first lid flap, the second lid flap, the third lid flap, and the fourth lid flap is under the bottom wall, such that each of said at least two flap wings is against the bottom wall and maintained under the bottom wall in the fully open configuration.

(25) The container according to (24), wherein the container is made of a single sheet of paperboard.

(26) The container according to (24) or (25), wherein the first hinge, the second hinge, the third hinge, the fourth hinge, and the fifth hinge are physically predefined hinges formed in the single sheet.

(27) The container according to any one of (24) to (26), wherein the fifth hinge is formed of perforations in the single sheet of paperboard.

(28) The container according to any one of (24) to (27), wherein the single sheet of paperboard is configured to store foodstuff.

(29) The container according to any one of (24) to (28), wherein only two of the first lid flap, the second lid flap, the third lid flap, and the fourth lid flap each include the flap body and the flap wing connected to the flap body via the fifth hinge.

(30) The container according to any one of (24) to (29), wherein said only two lid flaps are the third lid flap and the fourth lid flap, and wherein the flap wing of each of the third lid flap and the fourth lid flap is under the bottom wall pointing toward the other flap wing such that each of the flap wings is flat against the bottom wall and maintained under the bottom wall and, together, form a base for the container in the fully open configuration.

(31) The container according to any one of (24) to (30), wherein, in a fully closed configuration of the container, the first lid flap, the second lid flap, the third lid flap, and the fourth lid flap are parallel or substantially parallel to the bottom wall, the first and second lid flaps do not overlap each other, and the third and fourth lid flaps overlap each over and the first and second lid flaps.

(32) The container according to any one of (24) to (31), wherein the first lid flap and the second lid flap have a first geometric configuration, and wherein the third lid flap and the fourth lid flap having a second geometric configuration different from the first geometric configuration.

(33) The container according to any one of (24) to (32), wherein each of the fifth hinges is formed by a perforated line between the flap body and the flap wing.

(34) The container according to any one of (24) to (33), further comprising: a first folding wall between the first sidewall and the third sidewall; a second folding wall between the first sidewall and the fourth sidewall; a third folding wall between the second sidewall and the third sidewall; and a fourth folding wall between the second sidewall and the fourth sidewall, wherein each of the first lid flap and the second lid flap includes a pair of opposing retention flanges, wherein, in the fully open configuration, one of the retention flanges of the first lid flap is arranged between the first sidewall and the first folding wall and another of the retention flanges of the first lid flap is arranged between the first sidewall and the second folding wall, such that the first lid flap is folded at the first hinge and arranged adjacent to the first sidewall, and wherein, in the fully open configuration, one of the retention flanges of the second lid flap is arranged between the second sidewall and the third folding wall and another of the retention flanges of the second lid flap is arranged between the second sidewall and the fourth folding wall, such that the second lid flap is folded at the second hinge and arranged adjacent to the second sidewall.

(35) The container according to any one of (24) to (34), wherein, in the fully open configuration, the flap wings of the third lid flap and the fourth lid flap do not overlap or touch each other when arranged flat against the bottom wall and maintained under the bottom wall.

(36) The container according to any one of (24) to (35), wherein a first height of the flap body is greater than a second height of each of the first lid flap and the second lid flap.

(37) The container according to any one of (24) to (36), wherein a first height of the flap body is greater than a third height of the flap wing.

(38) The container according to any one of (24) to (37), wherein a first height of the flap body is greater than a second height of each of the first lid flap and the second lid flap, wherein the first height of the flap body is greater than a third height of the flap wing, and wherein the second height of each of the first lid flap and the second lid flap is greater than the third height of the flap wing.

(39) A method regarding a container, the method comprising: providing a paper product; and providing a formed container formed from the paper product, wherein the formed container includes: a first sidewall, a second sidewall opposite the first sidewall, a third sidewall, a fourth sidewall opposite the third sidewall, a bottom wall connected to the first, second, third, and fourth sidewalls, a first lid flap connected to the first sidewall via a first hinge, a second lid flap connected to the second sidewall via a second hinge, a third lid flap connected to the third sidewall via a third hinge, and a fourth lid flap connected to the fourth sidewall via a fourth hinge, wherein at least two of the first lid flap, the second lid flap, the third lid flap, and the fourth lid flap each include a flap body and a flap wing connected to the flap body via a fifth hinge, and wherein, in a fully open configuration, at least two of the following are provided: the first lid flap is folded at the first hinge such that the flap body thereof is adjacent to the first sidewall, the second lid flap is folded at the second hinge such that the flap body thereof is adjacent to the second sidewall, the third lid flap is folded at the third hinge such that the flap body thereof is adjacent to the third sidewall, the fourth lid flap is folded at the fourth hinge such that the flap body thereof is adjacent to the fourth sidewall, and the flap wing of each of said at least two of the first lid flap, the second lid flap, the third lid flap, and the fourth lid flap is under the bottom wall, such that each of said at least two flap wings is against the bottom wall and maintained under the bottom wall in the fully open configuration.

(40) The method according to (39), wherein the formed container further includes: a first folding wall between the first sidewall and the third sidewall, a second folding wall between the first sidewall and the fourth sidewall, a third folding wall between the second sidewall and the third sidewall, and a fourth folding wall between the second sidewall and the fourth sidewall, wherein each of the first lid flap and the second lid flap includes a pair of opposing retention flanges, wherein, in the fully open configuration of the formed container, one of the retention flanges of the first lid flap is arranged between the first sidewall and the first folding wall and another of the retention flanges of the first lid flap is arranged between the first sidewall and the second folding wall, such that the first lid flap is folded at the first hinge and arranged adjacent to the first sidewall, and wherein, in the fully open configuration of the formed container, one of the retention flanges of the second lid flap is arranged between the second sidewall and the third folding wall and another of the retention flanges of the second lid flap is arranged between the second sidewall and the fourth folding wall, such that the second lid flap is folded at the second hinge and arranged adjacent to the second sidewall.

(41) The method according to (39) or (40), wherein an adhesive affixes the first folding wall and the second folding wall to the first sidewall and the third folding wall and the fourth folding wall to the second sidewall.

(42) The method according to any one of (39) to (41), wherein the formed container is configured to be arranged in a fully closed configuration such that the first lid flap, the second lid flap, the third lid flap, and the fourth lid flap are parallel or substantially parallel to the bottom wall, the first and second lid flaps do not overlap each other, and the third and fourth lid flaps overlap each other and the first and second lid flaps.

(43) A container comprising: a first sidewall; a second sidewall opposite the first sidewall; a third sidewall; a fourth sidewall opposite the third sidewall; a bottom wall connected to the first, second, third, and fourth sidewalls; a first lid flap connected to the first sidewall via a first hinge; a second lid flap connected to the second sidewall via a second hinge; a third lid flap connected to the third sidewall via a third hinge; and a fourth lid flap connected to the fourth sidewall via a fourth hinge, wherein at least two of the first lid flap, the second lid flap, the third lid flap, and the fourth lid flap each include a flap body and a flap wing connected to the flap body via a fifth hinge, and wherein, in a fully open configuration, the fifth hinges of said at least two of the first lid flap, the second lid flap, the third lid flap, and the fourth lid flap are adjacent to respective portions of the container where corresponding at least two of the first sidewall, the second sidewall, the third sidewall, and the fourth sidewall meet the bottom wall, such that each of the said at least two flap wings is against the bottom wall and maintained under the bottom wall in the fully open configuration.

(44) A method of providing, making and/or using the container according to any one of (24) to (38).

(45) A method of providing, making and/or using the container according to (43).

Having now described embodiments of the disclosed subject matter, it should be apparent to those skilled in the art that the foregoing is merely illustrative and not limiting, having been presented by way of example only. Thus, although particular configurations have been discussed and illustrated herein, other configurations can be and are also employed. Further, numerous modifications and other embodiments (e.g., combinations, rearrangements, etc.) are enabled by the present disclosure and are contemplated as falling within the scope of the disclosed subject matter and any equivalents thereto. Features of the disclosed embodiments can be combined, rearranged, omitted, etc., within the scope of described subject matter to produce additional embodiments. Furthermore, certain features may sometimes be used to advantage without a corresponding use of other features. Accordingly, Applicant intends to embrace all such alternatives, modifications, equivalents, and variations that are within the spirit and scope of the present disclosure.

The invention claimed is:

1. A container comprising:

a first sidewall;

a second sidewall opposite the first sidewall;

a third sidewall;

a fourth sidewall opposite the third sidewall;

a bottom wall connected to the first, second, third, and fourth sidewalls;

a first lid flap connected to the first sidewall via a first hinge;

a second lid flap connected to the second sidewall via a second hinge;

a third lid flap connected to the third sidewall via a third hinge; and a fourth lid flap connected to the fourth sidewall via a fourth hinge, wherein at least two of the first lid flap, the second lid flap, the third lid flap, and the fourth lid flap each include a flap body and a flap wing connected to the flap body via a fifth hinge, and wherein, in a fully open configuration, at least two of the following are provided: the first lid flap is folded at the first hinge such that the flap body thereof is adjacent to the first sidewall, the second lid flap is folded at the second hinge such that the flap body thereof is adjacent to the second sidewall, the third lid flap is folded at the third hinge such that the flap body thereof is adjacent to the third sidewall, the fourth lid flap is folded at the fourth hinge such that the flap body thereof is adjacent to the fourth sidewall, and the flap wing of each of said at least two of the first lid flap, the second lid flap, the third lid flap, and the fourth lid flap is under the bottom wall, such that each of said at least two flap wings is against the bottom wall and maintained under the bottom wall in the fully open configuration.

2. The container according to claim 1, wherein the container is made of a single sheet of paperboard.

3. The container according to claim 2, wherein the first hinge, the second hinge, the third hinge, the fourth hinge, and the fifth hinge are physically predefined hinges formed in the single sheet.

4. The container according to claim 2, wherein the fifth hinge is formed of perforations in the single sheet of paperboard.

5. The container according to claim 2, wherein the single sheet of paperboard is configured to store foodstuff.

6. The container according to claim 1, wherein only two of the first lid flap, the second lid flap, the third lid flap, and the fourth lid flap each include the flap body and the flap wing connected to the flap body via the fifth hinge.

7. The container according to claim 6, wherein said only two lid flaps are the third lid flap and the fourth lid flap, and wherein the flap wing of each of the third lid flap and the fourth lid flap is under the bottom wall pointing toward the other flap wing such that each of the flap wings is flat against the bottom wall and maintained under the bottom wall and, together, form a base for the container in the fully open configuration.

8. The container according to claim 1, wherein, in a fully closed configuration of the container, the first lid flap, the second lid flap, the third lid flap, and the fourth lid flap are parallel or substantially parallel to the bottom wall, the first and second lid flaps do not overlap each other, and the third and fourth lid flaps overlap each over and the first and second lid flaps.

9. The container according to claim 1, wherein the first lid flap and the second lid flap have a first geometric configuration, and wherein the third lid flap and the fourth lid flap having a second geometric configuration different from the first geometric configuration.

10. The container according to claim 1, wherein each of the fifth hinges is formed by a perforated line between the flap body and the flap wing.

11. The container according to claim 1, further comprising:

a first folding wall between the first sidewall and the third sidewall;

a second folding wall between the first sidewall and the fourth sidewall;

a third folding wall between the second sidewall and the third sidewall; and a fourth folding wall between the second sidewall and the fourth sidewall, wherein each of the first lid flap and the second lid flap includes a pair of opposing retention flanges, wherein, in the fully open configuration, one of the retention flanges of the first lid flap is arranged between the first sidewall and the first folding wall and another of the retention flanges of the first lid flap is arranged between the first sidewall and the second folding wall, such that the first lid flap is folded at the first hinge and arranged adjacent to the first sidewall, and wherein, in the fully open configuration, one of the retention flanges of the second lid flap is arranged between the second sidewall and the third folding wall and another of the retention flanges of the second lid flap is arranged between the second sidewall and the fourth folding wall, such that the second lid flap is folded at the second hinge and arranged adjacent to the second sidewall.

12. The container according to claim 1, wherein, in the fully open configuration, the flap wings of the third lid flap and the fourth lid flap do not overlap or touch each other when arranged flat against the bottom wall and maintained under the bottom wall.

13. The container according to claim 1, wherein a first height of the flap body is greater than a second height of each of the first lid flap and the second lid flap.

14. The container according to claim 1, wherein a first height of the flap body is greater than a third height of the flap wing.

15. The container according to claim 1, wherein a first height of the flap body is greater than a second height of each of the first lid flap and the second lid flap, wherein the first height of the flap body is greater than a third height of the flap wing, and wherein the second height of each of the first lid flap and the second lid flap is greater than the third height of the flap wing.

16. A method regarding a container, the method comprising:

providing a paper product; and providing a formed container formed from the paper product, wherein the formed container includes:

a first sidewall, a second sidewall opposite the first sidewall, a third sidewall, a fourth sidewall opposite the third sidewall, a bottom wall connected to the first, second, third, and fourth sidewalls, a first lid flap connected to the first sidewall via a first hinge, a second lid flap connected to the second sidewall via a second hinge, a third lid flap connected to the third sidewall via a third hinge, and a fourth lid flap connected to the fourth sidewall via a fourth hinge, wherein at least two of the first lid flap, the second lid flap, the third lid flap, and the fourth lid flap each include a flap body and a flap wing connected to the flap body via a fifth hinge, and wherein, in a fully open configuration, at least two of the following are provided: the first lid flap is folded at the first hinge such that the flap body thereof is adjacent to the first sidewall, the second lid flap is folded at the second hinge such that the flap body thereof is adjacent to the second sidewall, the third lid flap is folded at the third hinge such that the flap body thereof is adjacent to the third sidewall, the fourth lid flap is folded at the fourth hinge such that the flap body thereof is adjacent to the fourth sidewall, and the flap wing of each of said at least two of the first lid flap, the second lid flap, the third lid flap, and the fourth lid flap is under the bottom wall, such that each of said at least two flap wings is against the bottom wall and maintained under the bottom wall in the fully open configuration.

17. The method according to claim 16, wherein the formed container further includes:

a first folding wall between the first sidewall and the third sidewall, a second folding wall between the first sidewall and the fourth sidewall, a third folding wall between the second sidewall and the third sidewall, and a fourth folding wall between the second sidewall and the fourth sidewall, wherein each of the first lid flap and the second lid flap includes a pair of opposing retention flanges, wherein, in the fully open configuration of the formed container, one of the retention flanges of the first lid flap is arranged between the first sidewall and the first folding wall and another of the retention flanges of the first lid flap is arranged between the first sidewall and the second folding wall, such that the first lid flap is folded at the first hinge and arranged adjacent to the first sidewall, and wherein, in the fully open configuration of the formed container, one of the retention flanges of the second lid flap is arranged between the second sidewall and the third folding wall and another of the retention flanges of the second lid flap is arranged between the second sidewall and the fourth folding wall, such that the second lid flap is folded at the second hinge and arranged adjacent to the second sidewall.

18. The method according to claim 17, wherein an adhesive affixes the first folding wall and the second folding wall to the first sidewall and the third folding wall and the fourth folding wall to the second sidewall.

19. The method according to claim 18, wherein the formed container is configured to be arranged in a fully closed configuration such that the first lid flap, the second lid flap, the third lid flap, and the fourth lid flap are parallel or substantially parallel to the bottom wall, the first and second lid flaps do not overlap each other, and the third and fourth lid flaps overlap each other and the first and second lid flaps.

20. A container comprising:

a first sidewall;

a second sidewall opposite the first sidewall;

a third sidewall;

a fourth sidewall opposite the third sidewall;

a bottom wall connected to the first, second, third, and fourth sidewalls;

a first lid flap connected to the first sidewall via a first hinge;

a second lid flap connected to the second sidewall via a second hinge;

a third lid flap connected to the third sidewall via a third hinge; and a fourth lid flap connected to the fourth sidewall via a fourth hinge, wherein at least two of the first lid flap, the second lid flap, the third lid flap, and the fourth lid flap each include a flap body and a flap wing connected to the flap body via a fifth hinge, and wherein, in a fully open configuration, the fifth hinges of said at least two of the first lid flap, the second lid flap, the third lid flap, and the fourth lid flap are adjacent to respective portions of the container where corresponding at least two of the first sidewall, the second sidewall, the third sidewall, and the fourth sidewall meet the bottom wall, such that each of the said at least two flap wings is against the bottom wall and maintained under the bottom wall in the fully open configuration.

* * * * *